US012264572B2

(12) United States Patent
Al Haji

(10) Patent No.: US 12,264,572 B2
(45) Date of Patent: Apr. 1, 2025

(54) SYSTEM AND METHOD TO PREDICT AND OPTIMIZE DRILLING ACTIVITIES

(71) Applicant: SAUDI ARABIAN OIL COMPANY, Dhahran (SA)

(72) Inventor: Ahmed Mohammed Al Haji, Al Umran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 351 days.

(21) Appl. No.: 17/707,098

(22) Filed: Mar. 29, 2022

(65) Prior Publication Data

US 2023/0313666 A1 Oct. 5, 2023

(51) Int. Cl.

| | |
|---|---|
| ***E21B 44/02*** | (2006.01) |
| ***E21B 45/00*** | (2006.01) |
| ***E21B 47/12*** | (2012.01) |

(52) U.S. Cl.

CPC ..... *E21B 44/02* (2013.01); *E21B 45/00* (2013.01); *E21B 47/12* (2013.01); *E21B 2200/20* (2020.05); *E21B 2200/22* (2020.05)

(58) Field of Classification Search

CPC .. E21B 2200/20; E21B 2200/22; E21B 44/00; E21B 44/02; E21B 45/00; E21B 47/12

See application file for complete search history.

(56) References Cited

U.S. PATENT DOCUMENTS

| | | | | |
|---|---|---|---|---|
| 6,246,952 | B1 | 6/2001 | Honda | |
| 9,989,661 | B2 | 6/2018 | Yang et al. | |
| 2007/0284147 | A1* | 12/2007 | Moran | E21B 44/00 702/9 |
| 2011/0186353 | A1* | 8/2011 | Turner | E21B 44/00 703/2 |
| 2013/0176139 | A1 | 7/2013 | Chau et al. | |

(Continued)

FOREIGN PATENT DOCUMENTS

| | | | | |
|---|---|---|---|---|
| CA | 3064241 | A1 * | 4/2014 | E21B 44/00 |
| CA | 2804075 | C | 8/2020 | |

(Continued)

*Primary Examiner* — Yoshihisa Ishizuka

(74) *Attorney, Agent, or Firm* — Osha Bergman Watanabe & Burton LLP

(57) ABSTRACT

A method may include obtaining a plurality of historical drilling signals for a plurality of wells and generating a plurality of drilling parameters from the plurality of historical drilling signals of drilling activities of the plurality of wells into one real-time database of a computer processor. The method further includes applying Fourier Transform to decompose a plurality of functions into the plurality of drilling parameters and determining an optimum drilling parameter based on one or more optimized drilling parameters. The method further includes recomposing the plurality of functions to automate drilling activities for new wells by generating trends of the one or more optimized drilling parameters and using the trends in the drilling activities. The method further includes creating Key Performance Indexes (KPIs) for the plurality of optimized drilling parameters to evaluate performance and monitor the drilling activities in real time using machine learning algorithms.

18 Claims, 5 Drawing Sheets

(56) References Cited

U.S. PATENT DOCUMENTS

| | | | | |
|---|---|---|---|---|
| 2014/0326449 | A1* | 11/2014 | Samuel | E21B 41/00<br>340/853.3 |
| 2023/0117396 | A1* | 4/2023 | Chanpura | E21B 44/00<br>175/50 |

FOREIGN PATENT DOCUMENTS

| | | | | |
|---|---|---|---|---|
| CA | 3123941 | A1 * | 8/2020 | E21B 44/00 |
| RU | 2605105 | C2 | 12/2016 | |

* cited by examiner

SYSTEM AND METHOD TO PREDICT AND OPTIMIZE DRILLING ACTIVITIES

BACKGROUND

Drilling activities of a well are monitored in real-time in most cases. Drilling surface-measured parameters (or drilling parameters) like Weight On Bit (WOB), Rotation Per Minute (RPM), Gallon Per Minutes (GPM), hook-load, torque, and bit depth are among many drilling parameters measured normally. Those parameters get measured using different measuring units, however, all of them are measured per time (minutes normally). Each parameter has a signal by its own that can be filtered for further evaluation. One of the evaluations done is the Rate of Penetration (ROP) analysis, which is a function of various drilling parameters, for example, WOB, RPM, GPM, hook-load, torque, and bit depth. The faster the ROP the lesser the cost of drilling activities. However, maximizing those drilling parameters are not always going to yield to a better ROP. In some type of formations, the faster the RPM, the faster the ROP, aside from time and depth. In others, the higher the WOB, the faster the ROP. Thus, the optimum ROP would be reached by optimizing those drilling parameters individually. Accordingly, there exists a need for an efficient real-time method to optimize, automate, and predict ROP to enhance the drilling parameters and/or automate the drilling activities of the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for predicting and optimizing drilling activities. The method includes obtaining a plurality of historical drilling signals for a plurality of wells such that at least one of the plurality of historical drilling signals describes a drilling parameter that is measured during a drilling activity. The method further includes generating a plurality of drilling parameters from the plurality of historical drilling signals of drilling activities of the plurality of wells into one real-time database of a computer processor. The method further includes applying Fourier Transform to decompose a plurality of functions into the plurality of drilling parameters and determining an optimum drilling parameter based on one or more optimized drilling parameters generated after measuring, analyzing, and filtering the plurality of drilling parameters. The method further includes recomposing the plurality of functions to automate drilling activities for new wells by generating trends of the one or more optimized drilling parameters. The method further includes using the trends of the one or more optimized drilling parameters in making a decision related to the drilling activities based on prediction of a compressive strength of different formations of at least one well of the plurality of wells. The method further includes creating Key Performance Indexes (KPIs) for the plurality of optimized drilling parameters to evaluate performance and monitor the drilling activities in real time using machine learning algorithms. At least one function among the plurality of functions is a Rate of Penetration (ROP) and the optimum drilling parameter is an optimum ROP based on the one or more optimized drilling parameters.

In another aspect, embodiments disclosed herein generally relate to a system that includes a drilling system and a logging system coupled to the drilling system which include a plurality of drill bit logging tools. The system further includes a control system coupled to a plurality of sensors. The system further includes a reservoir simulator that includes a computer processor. The reservoir simulator is coupled to the logging system and the drilling system. The reservoir simulator obtains a plurality of historical drilling signals for a plurality of wells such that at least one of the plurality of historical drilling signals describes a drilling parameter that is measured during a drilling activity. The reservoir simulator generates a plurality of drilling parameters from the plurality of historical drilling signals of drilling activities of the plurality of wells into one real-time database of a computer processor. The reservoir simulator applies Fourier Transform to decompose a plurality of functions into the plurality of drilling parameters and determines an optimum drilling parameter based on one or more optimized drilling parameters generated after measuring, analyzing, and filtering the plurality of drilling parameters. The reservoir simulator recomposes the plurality of functions to automate drilling activities for new wells by generating trends of the one or more optimized drilling parameters. The reservoir simulator uses the trends of the one or more optimized drilling parameters in making a decision related to the drilling activities based on prediction of a compressive strength of different formations of at least one well of the plurality of wells. The reservoir simulator creates Key Performance Indexes (KPIs) for the plurality of optimized drilling parameters to evaluate performance and monitor the drilling activities in real time using machine learning algorithms. At least one function among the plurality of functions is a Rate of Penetration (ROP) and the optimum drilling parameter is an optimum ROP based on the one or more optimized drilling parameters.

In another aspect, embodiments disclosed herein generally relate to a non-transitory computer readable medium storing instruction. The instructions are executable by a computer processor and include functionality for obtaining a plurality of historical drilling signals for a plurality of wells such that at least one of the plurality of historical drilling signals describes a drilling parameter that is measured during a drilling activity. The instruction further includes generating a plurality of drilling parameters from the plurality of historical drilling signals of drilling activities of the plurality of wells into one real-time database of a computer processor. The instruction further includes applying Fourier Transform to decompose a plurality of functions into the plurality of drilling parameters and determining an optimum drilling parameter based on one or more optimized drilling parameters generated after measuring, analyzing, and filtering the plurality of drilling parameters. The instruction further includes recomposing the plurality of functions to automate drilling activities for new wells by generating trends of the one or more optimized drilling parameters. The instruction further includes using the trends of the one or more optimized drilling parameters in making a decision related to the drilling activities based on prediction of a compressive strength of different formations of at least one well of the plurality of wells. The instruction further includes creating Key Performance Indexes (KPIs) for the plurality of optimized drilling parameters to evaluate performance and monitor the drilling activities in real time using machine learning algorithms. At least one function among the plurality of functions is a Rate of Penetration (ROP) and the optimum drilling parameter is an optimum ROP based on the one or more optimized drilling parameters.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
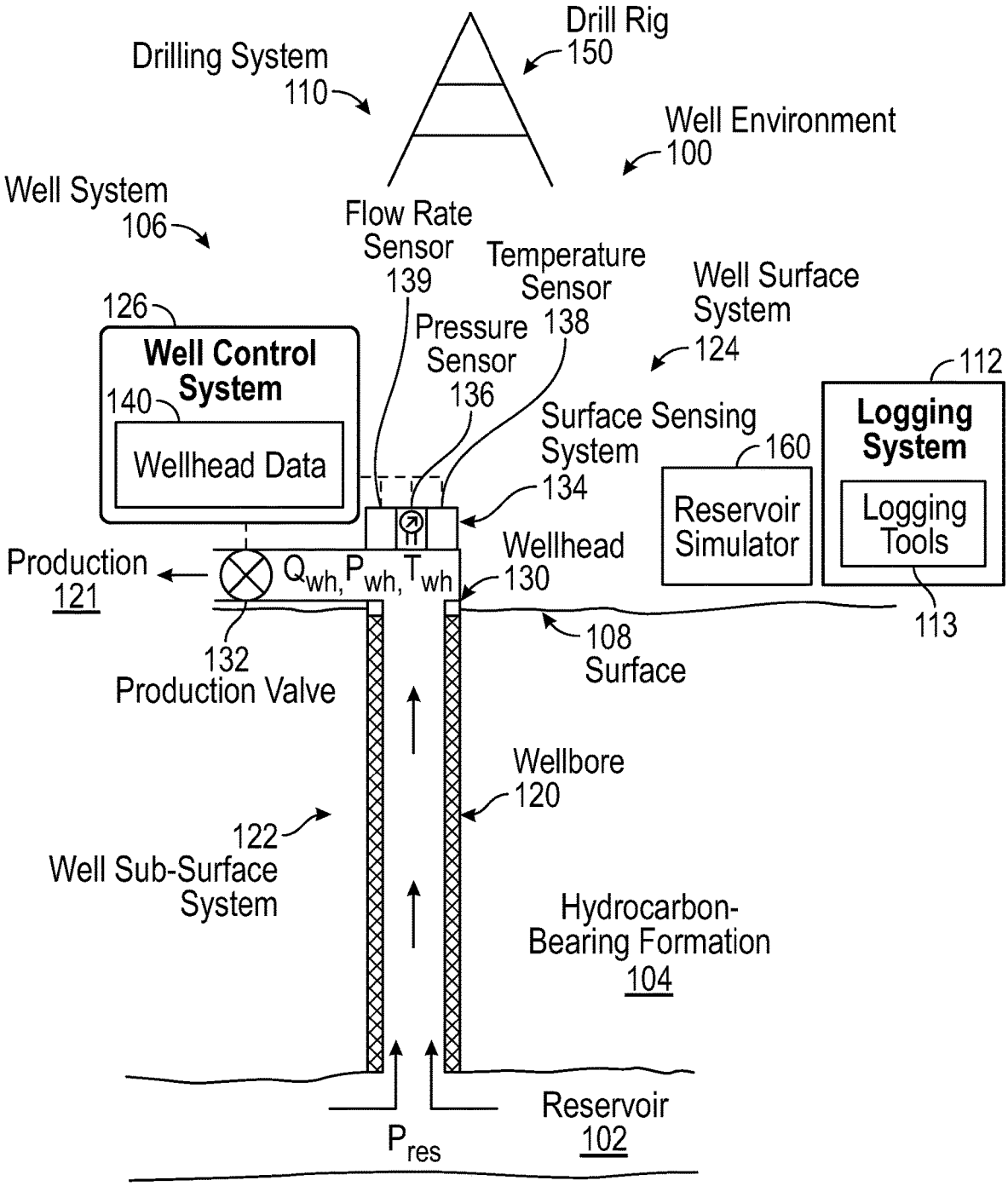
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-4, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a horizontal beam" includes reference to one or more of such beams.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that, one or more of the steps shown in the flowcharts may be omitted, repeated, and/or performed in a different order than the order shown. Accordingly, the scope of the invention should not be considered limited to the specific arrangement of steps shown in the flowcharts.

Although multiply dependent claims are not introduced, it would be apparent to one of ordinary skill that the subject matter of the dependent claims of one or more embodiments may be combined with other dependent claims.

In general, one or more embodiments disclosed herein are directed to a real-time method of predicting and optimizing drilling parameters during a drilling process of a well. In particular, embodiments disclosed herein do not need to employ downhole sensing devices to measure the drilling parameters. In one or more embodiments, the method disclosed herein uses Fourier Transform to decompose the signal of each drilling parameter and recompose those signals again to generate trends. Those trends are helpful in making an informative decision related to the drilling activities of previously drilled and new wells. Based on optimized parameters, an enhanced Rate of Penetration (ROP) is predicted. Also, informative and critical decisions may be taken based on the trends seen from each formation to identify the formation. For example, such critical decisions may involve decisions regarding casing installation of the new well, such as determining which is a good casing point for the new well.

The ROP is a function of various drilling parameters (or drilling surface-measured parameters), for example, WOB, RPM, GPM, hook-load, torque, and bit depth. In one or more embodiments, the Fourier Transform is used to decompose the ROP function to the above-mentioned drilling parameters, subsequently to be recomposed and used to predict those drilling parameters using machine-learning models to the optimum value. Thus, embodiments of the present disclosure may provide a method to transform drilling parameters using Fourier Transform. Advantageously, this method allows for prediction of ROP, enhancement of the ROP, prediction of problematic drilling zones (for example, loss circulation zones and super-charged formations), suggestion of optimum drilling parameters, and the ability to set, evaluate, and monitor drilling Key Performance Indexes (KPIs) in real-time using machine-learning models.

An objective of embodiments disclosed herein is to use historic data acquired from previously drilled wells to predict and optimize ROP and/or automate the drilling activities. Embodiments disclosed herein may be used to enhance the performance and reduce the cost of drilling activities by having an optimized ROP. The system and method may also be used to determine formation compressive strength while drilling, as well as setting drilling parameter KPIs.

FIG. 1 shows a schematic diagram in accordance with one or more embodiments. More specifically, FIG. 1 illustrates a well environment (100) in which a real-time monitoring system to monitor and enhance performance of drilling activities may be implemented, includes a hydrocarbon reservoir ("reservoir") (102) located in a subsurface hydrocarbon-bearing formation ("formation") (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, capillary pressure, and resistivity. In the case of the well system (106) being operated as a production well, the well system (106) may facilitate the extraction of hydrocarbons (or "production") from the reservoir (102).

The well environment (100) may include a drilling system (110) and a logging system (112). The drilling system (110) may include a drill string, drill bit or a mud circulation system for use in boring the wellbore (120) into the hydrocarbon-bearing formation (104).

The logging system (112) may include one or more logging tools (113), such as a nuclear magnetic resonance (NMR) logging tool or a resistivity logging tool, for use in logging wellhead data (140) of the formation (104). For example, a logging tool may be lowered into the wellbore (120) to acquire measurements as the tool traverses a depth interval (for example, targeted reservoir section) of the wellbore (120). The plot of the logging measurements versus depth may be referred to as a "log" or "well log". Well logs may provide depth measurements of the well system (106) that describe such reservoir characteristics as formation porosity, formation permeability, resistivity, water saturation, and the like. The resulting logging measurements may be stored or processed or both, for example, by the well control system (126), to generate corresponding well logs for the well system (106). A well log may include, for example, a plot of a logging response time versus true vertical depth (TVD) across the depth interval of the wellbore (120).

In some embodiments, the well system (106) includes a drill rig (150), a wellbore (120), a well sub-surface system (122), a well surface system (124), and a well control system ("control system") (126). The drill rig (150) is the machine used to drill a borehole to form the wellbore (120). The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "down-hole" end of the wellbore (120). The wellbore (120) may facilitate the circulation of drilling fluids during drilling operations, the flow of hydrocarbon production ("production") (121) (for example, oil and gas) from the reservoir (102) to the surface (108) during production operations, the injection of substances (for example, water) into the hydrocarbon-bearing formation (104) or the reservoir (102) during injection operations, or the communication of monitoring devices (for example, logging tools) into the hydrocarbon-bearing formation (104) or the reservoir (102) during monitoring operations (for example, during in situ logging operations). In one or more embodiments, the reservoir (102) may be located in geo-thermal wells or drilling tunnels for measuring one or more drilling parameters during the drilling activities.

In some embodiments, the control system (126) may control various operations of the well system (106), such as well production operations, well completion operations, well maintenance operations, and reservoir monitoring, assessment, and development operations. The control system (126) may include hardware or software for managing drilling operations or maintenance operations. For example, the control system (126) may include one or more programmable logic controllers (PLCs) (252) (shown in FIG. 2B) that include hardware or software with functionality to control one or more processes performed by the drilling system (110). Specifically, a programmable logic controller may control valve states, fluid levels, pipe pressures, warning alarms, or pressure releases throughout a drilling rig. In particular, a programmable logic controller may be a ruggedized computer system with functionality to withstand vibrations, extreme temperatures (for example, ~575° C.), wet conditions, or dusty conditions, for example, around the drill rig (150). Without loss of generality, the term "control system" may refer to a drilling operation control system that is used to operate and control the equipment, a drilling data acquisition and monitoring system that is used to acquire drilling process and equipment data and to monitor the operation of the drilling process, or a drilling interpretation software system that is used to analyze and understand drilling events and progress. In some embodiments, the control system (126) includes a computer system that is the same as or similar to that of computing system (400) described below in FIG. 4 and the accompanying description.

In some embodiments, sensors may be included in the well control system (126) that includes a processor, memory, and an analog-to-digital converter for processing sensor measurements. For example, the sensors may include acoustic sensors, such as accelerometers, measurement microphones, contact microphones, and hydrophones. Likewise, the sensors may include other types of sensors, such as transmitters and receivers to measure resistivity or gamma ray detectors. The sensors may include hardware or software or both for generating different types of well logs (such as acoustic logs or sonic longs) that may provide data about a wellbore on the formation, including porosity of wellbore sections, gas saturation, bed boundaries in a geologic formation, fractures in the wellbore or completion cement. If such well data is acquired during drilling operations (that is, logging-while-drilling), then the information may be used to adjust drilling operations in real-time. Such adjustments may include rate of penetration (ROP), drilling direction, and altering mud weight.

In some embodiments, the well sub-surface system (122) includes casing installed in the wellbore (120). For example, the wellbore (120) may have a cased portion and an uncased (or "open-hole") portion. The well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

Figure 2A:
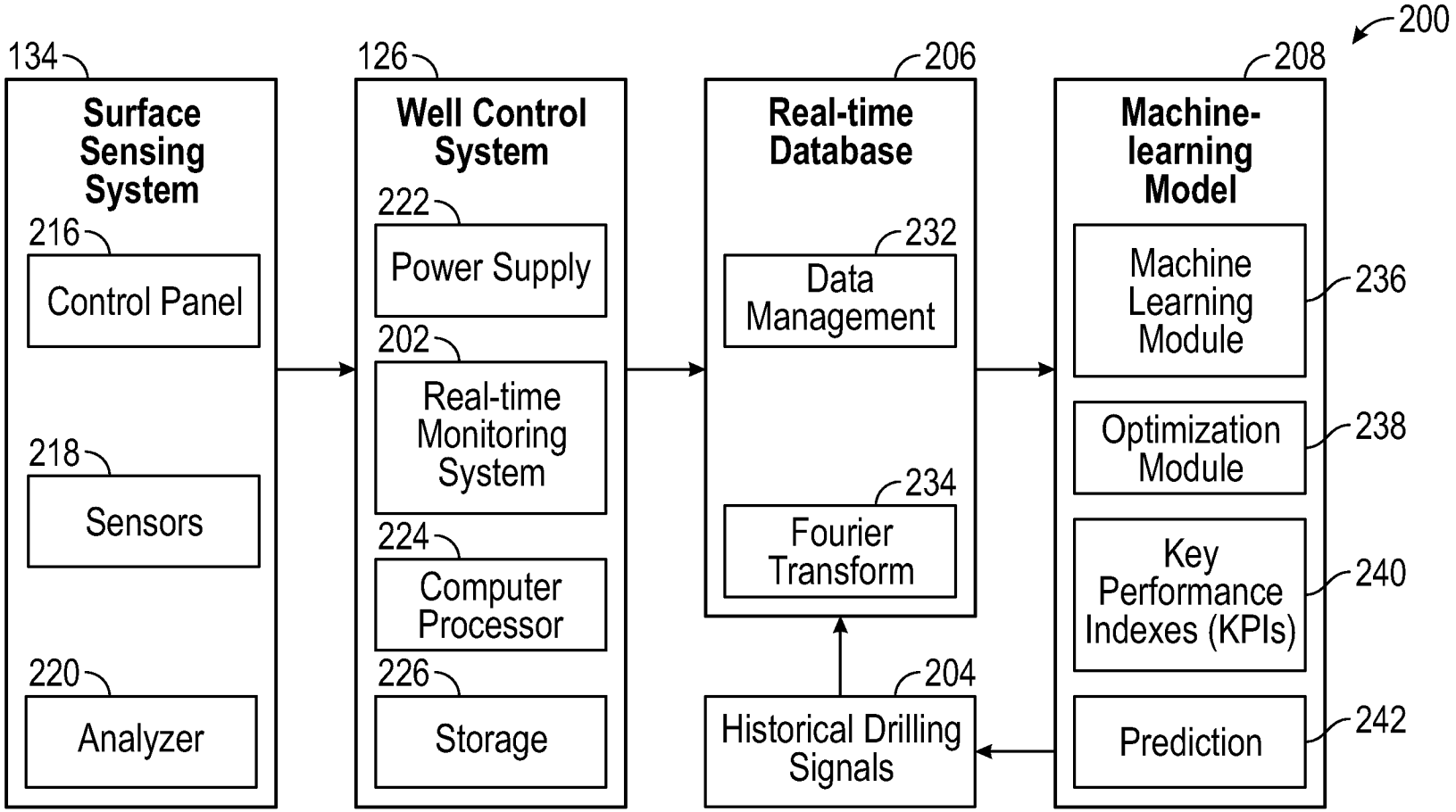
FIG. 2A shows a block diagram of a system in accordance with one or more embodiments.

Keeping with FIG. 1, in some embodiments, the well surface system (124) includes a surface sensing system (134). The surface sensing system (134) may include sensors (218), as shown in FIG. 2A, for sensing characteristics of substances, including production (121), passing through or otherwise located in the well surface system (124). The characteristics may include, for example, pressure, temperature, and flow rate of production (121) flowing through the wellhead (130), or other conduits of the well surface system (124), after exiting the wellbore (120).

In some embodiments, the sensors (218) of the surface sensing system (134) may further include a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the sensors (218) of the surface sensing system (134) may include a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" ($T_{wh}$). In some embodiments, the sensors (218) of the surface sensing system (134) may include a flow rate sensor (139) operable to sense the flow rate of production (121) flowing through the well surface system (124), after it exits the wellbore (120). The flow rate sensor (139) may include hardware that senses a flow rate of production (121) ($Q_{wh}$) passing through the wellhead (130).

In some embodiments, the surface sensing system (134) may include a control panel (216) and an analyzer (220), as shown in FIG. 2A. In such an embodiment, as mentioned-above, the sensors (218) are used to monitor and measure the power and fuel consumption during drilling activities, pressure, temperature, load, and RPM of an exhaust fuel. The time-based measurements related to the drilling activities for an interval of interest are taken by the sensors (218), converted to respective signals, and fed to the control panel (216) for further analysis using the analyzer (220). The measurements are recorded in real-time, and are available for review or use within seconds, minutes or hours of the condition being sensed (for example, the measurements are available within 1 hour of the condition being sensed). The wellhead data (140) may be referred to as "real-time" wellhead data (140). For example, the wellhead data may include real-time drilling data, geological data, or petrophysical data. The real-time drilling data describes a surface-measured drilling parameter which may include all static drilling parameters and dynamic drilling parameters of the wellbore. The interval of interest may be a particular depth interval within a formation, for example.

Real-time wellhead data (140) may enable an operator of the well system (106) to assess a relatively current state of the well system (106) and make real-time decisions regarding development of the well system (106) and the reservoir (102), such as on-demand adjustments in regulation of production flow from the well.

In some embodiments, the well control system (126) through the logging system (112) collects and records wellhead data (140) for the well system (106). A real-time monitoring system (202), as depicted in FIG. 2A, may generate datasets of dynamic data based on the collected wellhead data (140).

In some embodiments, the well system (106) is provided with a reservoir simulator (160). For example, a machine learning model (208) depicted in FIG. 2A may be part of the reservoir simulator (160) that includes hardware and/or software with functionality for analyzing well log data and/or performing one or more reservoir simulations. For example, the reservoir simulator (160) may store well logs and data regarding core samples for performing simulations. The reservoir simulator (160) may further analyze the well log data, the core sample data, seismic data, and/or other types of data to generate and/or update the one or more reservoir models. While the reservoir simulator (160) is shown at a well site, embodiments are contemplated where reservoir simulators are located away from well sites. the reservoir simulator (160) may include hardware or software with functionality for generating one or more trained models regarding the formation (104). For example, the reservoir simulator (160) may store well logs and data regarding core samples, and further analyze the well log data, the core sample data, seismic data, or other types of data to generate or update the one or more trained models having a complex geological environment. For example, different types of models may be trained, such as machine learning, artificial intelligence, convolutional neural networks, deep neural networks, support vector machines, decision trees, inductive learning models, deductive learning models, and supervised learning models, and are capable of approximating solutions of complex non-linear problems. The reservoir simulator (160) may couple to the logging system (112) and the drilling system (110).

In some embodiments, the reservoir simulator (160) may include functionality for applying machine learning and deep learning methodologies to precisely determine various subsurface layers. To do so, a large amount of interpreted data may be used to train a model. To obtain this amount of data, the reservoir simulator (160) may augment acquired data for various geological scenarios and drilling situations. For example, drilling logs may provide similar log signatures for a particular subsurface layer except where a well encounters abnormal cases. Such abnormal cases may include, for example, changes in subsurface geological compositions, well placement of artificial materials, or various subsurface mechanical factors that may affect logging tools. As such, the amount of well data with abnormal cases available to the reservoir simulator (160) may be insufficient for training a model. Therefore, in some embodiments, the reservoir simulator (160) may use data augmentation to generate a dataset that combines original acquired data with augmented data based on geological and drilling factors. This supplemented dataset may provide sufficient training data to train a model accordingly. In some embodiments, downhole physical sensors may not be needed in order to take accurate measurement of various drilling parameters. And based on the optimized drilling parameters obtained from the trained model and trends are generated to make an informative decision related to drilling activities.

In some embodiments, the reservoir simulator (160) is implemented in a software platform for the well control system (126). The software platform may obtain data acquired by the drilling system (110) and logging system (112) as inputs, which may include multiple data types from multiple sources. The software platform may aggregate the data from these systems (110, 112) in real time for rapid analysis. Real-time of or relating to computer systems in the software platform is defined as the actual time for updating information with instantaneous processing at the same rate as required by a user or necessitated by a process being controlled. In some embodiments, the well control system (140), the logging system (112), or the reservoir simulator (160) may include a computing system that is similar to the computing system (400) described with regard to FIG. 4 and the accompanying description.

Turning to FIG. 2A, FIG. 2A illustrates a block diagram of a system for predicting and optimizing drilling activities (200) in accordance with one or more embodiments. More specifically, FIG. 2A shows the major components of the surface sensing system (134) and the well control system (126) of FIG. 1 that are used in real-time monitoring and enhancing the performance of drilling activities. In particular, the system (200) includes the surface sensing system (134), the well control system (126) which includes a real-time monitoring system (202), a real-time database (206) and a machine-learning model (208). The surface sensing system (134) has already been discussed previously in detail in FIG. 1 and the accompanying description. The remaining components are discussed in detail below.

Figure 4:
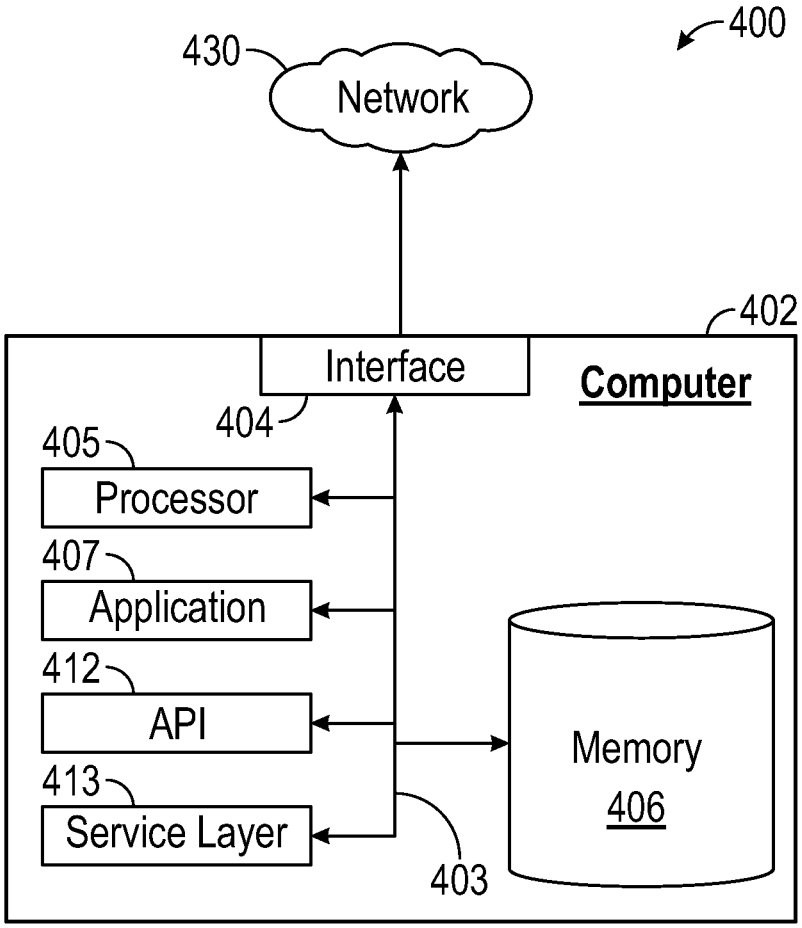
FIG. 4 shows a computing system in accordance with one or more embodiments.

In one or more embodiments, the well control system (126) may include the real-time monitoring system (202) which may run on any computing device such as that shown in FIG. 4 and may be remote to or part of the system (200). The well control system (126) may further include a power supply (222) which is a hardware component to supply power to all other components of the system. For example, the power supply (222) may convert a 110-115 or 220-230 volt AC (alternating current) into a steady low-voltage DC (direct current) usable by the computer processor (224). In some embodiments, the well control system (126) includes a computer processor (224) or a PLC (252), shown in FIG. 2B, that may be the same as or similar to that of the processor (405) described below in FIG. 4 and the accompanying description. The well control system (126) may further include a storage (226) which may be either a non-persistent storage (for example, volatile memory, such as random access memory (RAM), cache memory) or a persistent storage (for example, a hard disk, an optical drive such as a compact disk (CD) drive or digital versatile disk (DVD) drive, a flash memory).

In some embodiments, in addition to the real-time monitoring system (202) for the drilling activities, a real-time database (206) is also generated. The real-time database (210) may run on any computing device such as that shown in FIG. 4 and may be remote to or part of the system (200) and may be any repository or data structure for storing data in any suitable format. In one or more embodiments, the real-time database (206) may take as input historical drilling signals (204) of various surface-measured drilling parameters from various previously drilled wells. For example, the historical drilling signals (204) may include the real-time drilling parameters including all static drilling parameters and dynamic drilling parameters of the wellbore. For example, the static drilling parameters may include a size of the wellbore, a bit depth, a size of previous casing, or a location of the well. Similarly, the dynamic parameters may include, for example, a speed at which a drill bit can break a rock to deepen the wellbore (rate of penetration (ROP)), a torque produced by a drill to turn an object, a measurement of flow rate to determine how many gallons a pump can move per minute (gallons per minute (GPM)), standpipe pressure, an amount of downward force exerted on the drill bit provided by a plurality of drill collars in a drill assembly (weight on bit (WOB)), rotations per minute (RPM), an amount of total force pulling down on the hook (hook-load) (includes the weight of the drill string in air, the drill collars and any ancillary equipment, reduced by any force that tends to reduce that weight), or like.

The real-time database (206) may include specific modules with particular functionalities, such as a data management (232) and a Fourier Transform (234) in addition to the modules already mentioned above for the real-time monitoring system (202). The data management (232) module stores and manages data sets and the historical drilling signals (204) of the previously drilled wells, and data sets from the real-time operating parameters of the drilling activities obtained from the real-time monitoring system (202). In one or more embodiments, both data sets are linked to establish optimum drilling parameters computed using the machine-learning model (208), which forms a basis of continuously updated historical drilling signals (204) of the drilling activities of the previously drilled wells. The Fourier Transform (234) module uses the time-based measurements of various drilling parameters on a Fourier Transform algorithm, which is a mathematical technique to transform a function of time $x(t)$ to a function of frequency $X(\omega)$ and amplitude to predict and optimize the ROP functions as well as each individual drilling parameter. Thus, the real-time database (206) uses the Fourier Transform (234) module to decompose the ROP functions into each drilling parameter (both static drilling parameters and dynamic drilling parameters mentioned above), stores and manages in the data management (232) module and allows for more optimization and prediction in the machine-learning model (212) to strengthen training of the reservoir simulator (160) for drilling activities of new wells.

In one or embodiments, the machine-learning model (208) may include specific modules with particular functionalities, such as a machine-learning (236), an optimization (238), a Key Performance Indexes (KPIs) (240), and a Prediction (242) in addition to the modules already mentioned above for the real-time monitoring system (202). The machine-learning module (236) is a software capable of recomposing the ROP functions from optimized drilling parameters using machine learning algorithms to automate the drilling activities for the new wells. In particular, the machine-learning (236) module measures, analyzes, and filters the drilling parameters (signals) obtained from the real-time database (206) and generates one or more signals useful in the determination of the optimum drilling parameter using the optimization (238) module and prediction (242) module to be applied in the particular field and depth to generate trends, as well as creating some KPIs using the KPIs module (240) to follow-up on the performance of the drilling activities of the new wells based on the trends. These trends are helpful in making an informative decision related to the drilling activities.

In one or more embodiments, the optimum drilling parameter is an optimum ROP obtained from the one or more optimized drilling parameters. Thus, the optimum ROP may be obtained by optimizing the drilling parameters individually. For example, the ROP can be optimized by knowing the historically-proven optimum WOB at a particular depth, as well as the optimum RPM, hook-load, and torque. The optimum combination of these drilling parameters at a certain depth may be used to predict the ROP for each formation. The prediction module (242) may also be used to predict a compressive strength of rocks in the particular field and depth. This would be helpful in locating the casing point for each drilling section. Furthermore, it may be used to identify and avoid problematic mechanical drilling challenges, such as stuck-pipe, stick-and-slip, and loss zones.

Continuing with FIG. 2A, the machine learning (ML) module (236) stores the machine learning algorithms and equations used by the ML model (208) to perform advance analysis of datasets. For example, the ML module (236) may include a supervised ML algorithm, a Deep Learning (DL) algorithm, neural network models, physics-constrained machine learning (PCML) models, or any other suitable algorithm for performing prediction of optimum drilling parameter.

In one or more embodiments, the machine-learning model (208) includes functionality to generate action plans to enhance the performance and reduce the cost of drilling activities in real-time, determine formation compressive strength while drilling, as well as setting drilling parameter KPIs based on the current optimum drilling parameter. Finally, KPIs may be set, evaluated, and monitored in real-time using machine-learning model (208). In addition, the current optimum drilling parameter is established as a new optimum drilling parameter when current optimum KPIs and performance of the drilling activity are higher than the existing optimum KPIs and performance of the drilling activity the existing optimum KPIs. Further, the historical drilling signals (204) is updated based on the current optimum drilling parameter and KPIs.

Figure 2B:
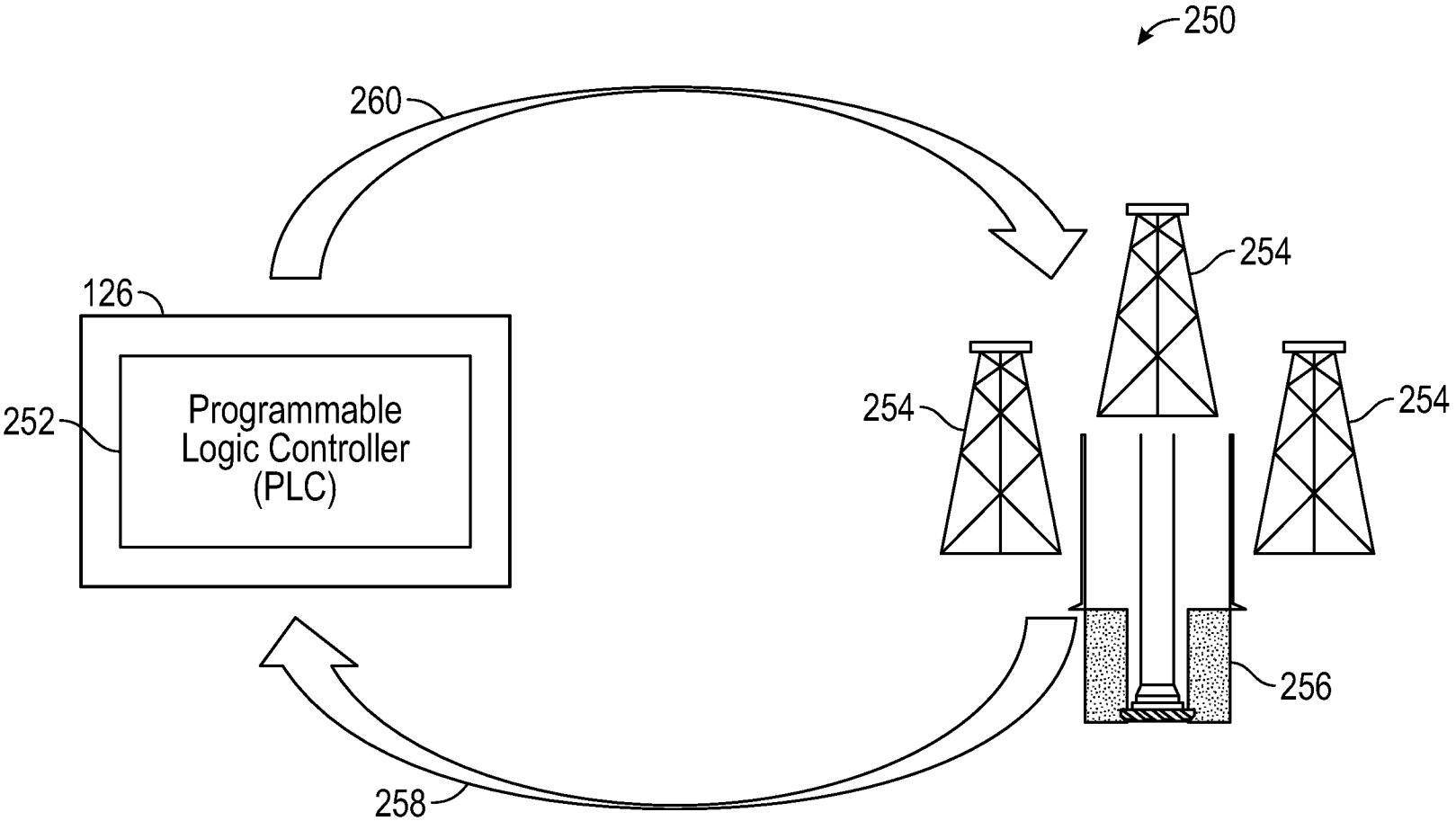
FIG. 2B shows a flow diagram of a system in accordance with one or more embodiments.

Turning to FIG. 2B, FIG. 2B illustrates a flow diagram of a system for predicting and optimizing drilling activities (250) in accordance with one or more embodiments. More specifically, FIG. 2B illustrates the well control system (126) in which the PLC (252) receives various historical drilling signals (258) based on previously drilled wells (254). In one or more embodiments, the PLC (252) may include the real-time database (206) and may be configured to apply the machine-learning model (208) (shown in FIG. 2A) to optimize current surface drilling parameters (260) for monitoring and enhancing performance of the drilling activities of a new well (256) in real-time and generate trends.

One or more embodiments disclosed herein may be used to predict the compressive strength of different formations of the wellbore and suggest optimized parameters to avoid problematic mechanical drilling challenges, such as stuck-pipe, stick-and-slip, or the like.

Figure 3:
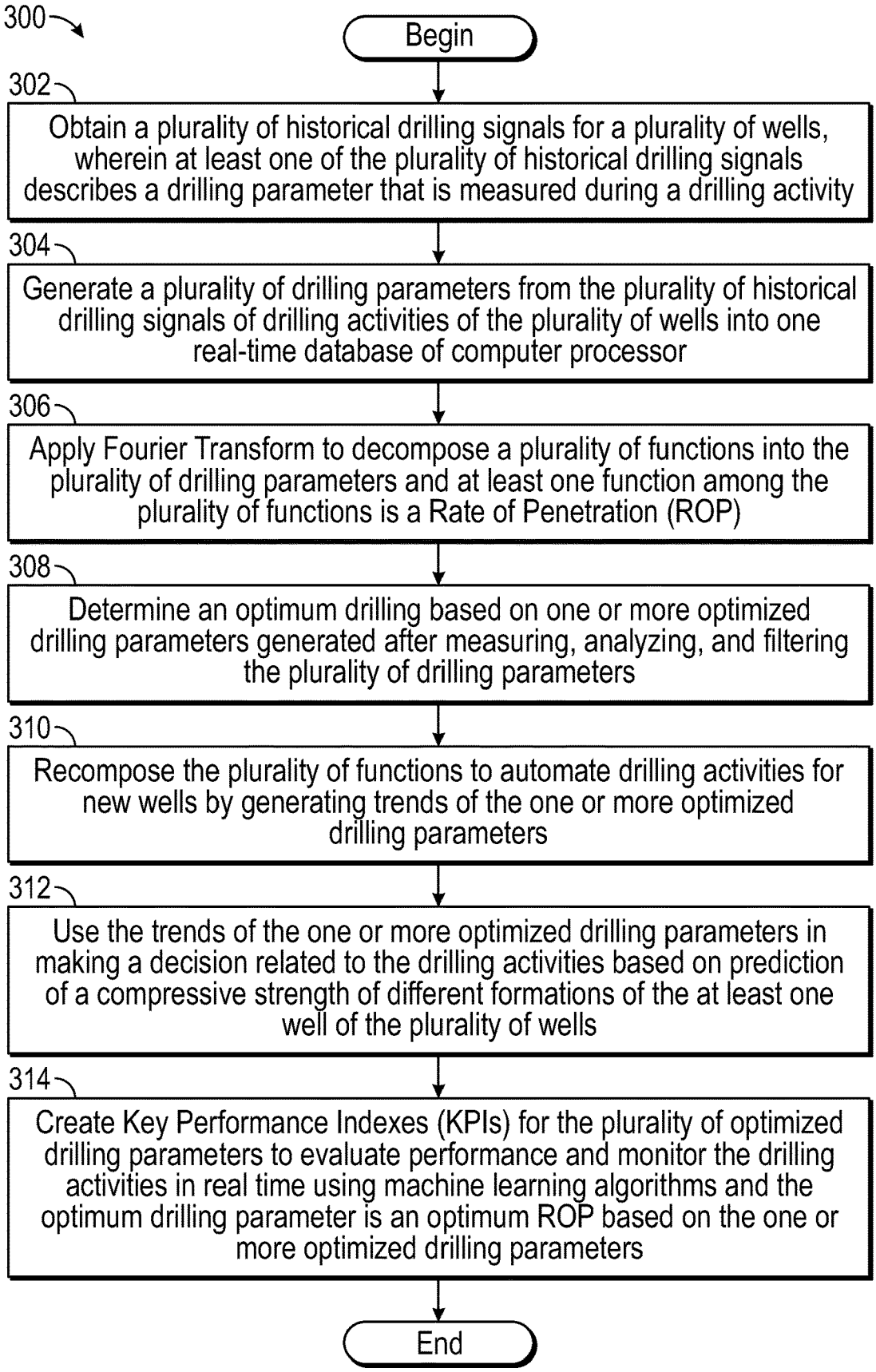
FIG. 3 shows a flowchart in accordance with one or more embodiments.

FIG. 3 shows a flowchart (300) in accordance with one or more embodiments. Specifically, FIG. 3 describes a general method for predicting and optimizing the drilling activities of a well. One or more steps in FIG. 3 may be performed by one or more components (for example, drilling system (110), logging system (112), well control system (126), surface sensing system (134), reservoir simulator (160), real-time monitoring system (202), historical drilling signals (204), real-time database (206), and machine-learning model (208)) as described in FIGS. 1, 2A, and 2B. While the various steps in FIG. 3 are presented and described sequentially, one of ordinary skill in the art will appreciate that some or all of the steps may be executed in different orders, may be combined, or omitted, and some or all of the steps may be executed in parallel. Furthermore, the steps may be performed actively or passively. The method may be repeated or expanded to support multiple components and/or multiple users within a field environment. Accordingly, the scope of the invention should not be considered limited to the specific arrangement of steps shown in the flowchart.

In step 302, a plurality of historical signals for a plurality of wells are obtained in accordance with one or more embodiments. At least one of the plurality of historical drilling signals describes a drilling parameter that is measured during a drilling activity. For example, the historical drilling signals may correspond to historical data of well logs of the drilling activities obtained for an interval of interest using a logging system (112) or logging tools (113) described previously in FIG. 1 and the accompanying description. For example, in one or more embodiments, the historical drilling signals may include real-time drilling data which may include all static drilling parameters and dynamic drilling parameters of the wellbore. For example, the static drilling parameters may include a size of the wellbore, a size of previous casing, or a location of the well. Similarly, the dynamic drilling parameters may include, for example, the ROP, the torque, the GPM, the standpipe pressure, the WOB, the RPM, the hook-load, or like. The ROP is a function of various drilling parameters, for example, WOB, RPM, GPM, hook-load, torque, and bit depth described previously in FIGS. 2A and 2B and the accompanying description.

In step 304, a plurality of drilling parameters is generated from the plurality of historical drilling signals of drilling activities of the plurality of wells into one real-time database in accordance with one or more embodiments. For example, the real-time database (206) may run on any computing device such as that shown in FIG. 4 and may be remote to or part of the system (200) and may be associated with any suitable database or repository for storing data in any form. In one or more embodiments, the real-time database (206) may take as input the historical drilling signals (204) of various surface-measured drilling parameters from various previously drilled wells described previously in FIG. 2A and the accompanying description.

In step 306, Fourier Transform is applied to decompose a plurality of functions into the plurality of drilling parameters in accordance with one or more embodiments. For example, the Fourier Transform (234) module uses the time-based measurements of various drilling parameters on a Fourier Transform algorithm to predict and optimize the ROP functions as well as each individual drilling parameter. Thus, the real-time database (206) uses the Fourier Transform (234) module to decompose the ROP functions into each drilling parameter described previously in FIG. 2A and the accompanying description.

In step 308, an optimum drilling parameter is determined based on one or more optimized drilling parameters generated after measuring, analyzing, and filtering the plurality of drilling parameters in accordance with one or more embodiments. In particular, the machine-learning (236) module measures, analyzes, and filters the drilling parameters (signals) obtained from the real-time database (206) and generates one or more signals useful in the determination of the optimum drilling parameter using the optimization (238) module and prediction (242) module to be applied in the particular field and depth described previously in FIG. 2A and the accompanying description. The optimum drilling parameter is an optimum ROP obtained from the one or more optimized drilling parameters.

In step 310, the plurality of functions is recomposed to automate drilling activities for new wells by generating trends of the one or more optimized drilling parameters in accordance with one or more embodiments. For example, the machine-learning module (236) recomposes the ROP functions from each optimized drilling parameter to automate the drilling activities for the new wells by generating trends of the one or more optimized drilling parameters in real-time described previously in FIGS. 2A and 2B and the accompanying description.

In step 312, the trends of the one or more optimized drilling parameters are used in making a decision related to the drilling activities based on prediction on a compressive strength of different formations of the at least one well in accordance with one or more embodiments. For example, an informative decision may be taken based on the generated trends seen from each formation to identify the formation, which is good to be a casing point, which is critical for the drilling activity of the new wells in real-time described previously in FIGS. 2A and 2B and the accompanying description.

In step 314, KPIs are created for the plurality of optimized drilling parameters to evaluate performance and monitor the drilling activities in real-time using machine learning algorithms in accordance with one or more embodiments. For example, the machine-learning model (208) includes functionality to generate action plans to enhance the performance and reduce the cost of drilling activities in real-time, determine formation compressive strength while drilling, as well as setting drilling parameter KPIs based on the current optimum drilling parameter. Finally, KPIs may be set, evaluated, and monitored in real-time using machine-learning model (208). In addition, the current optimum drilling parameter is established as a new optimum drilling parameter when current optimum KPIs and performance of the drilling activity are higher than the existing optimum KPIs and performance of the drilling activity the existing optimum KPIs described previously in FIG. 2A and the accompanying description.

Thus, those skilled in the art will appreciate that the flow chart of FIG. 3 is constantly executing to enhance the optimum drilling parameter ROP and/or automate the drilling activities while drilling operations are being performed, in real-time. Further, not only is the process of FIG. 3 continuous, but the process also shown may be repeated for each drilling parameter of the drilling activities of the well. In this manner, the surface-measured drilling parameters are transformed using Fourier Transform by decomposing functions into each drilling parameter and recompose those functions using the optimized drilling parameters to automate the drilling activities for the new wells.

One or more embodiments disclosed herein provides devices, assemblies, systems, and methods to predict the compressive strength of the rock. This would be helpful in locating the casing point for each drilling section. Furthermore, it can be used to identify and avoid problematic mechanical drilling challenges, such as stuck-pipe, stick-and-slip, loss zones, or the like.

Embodiments may be implemented on a computing system. FIG. 4 depicts a block diagram) of a computing system (400) including a computer (402) used to provide computational functionalities associated with described machine learning networks, algorithms, methods, functions, processes, flows, and procedures as described in this disclosure, according to one or more embodiments. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols, such as the Wellsite Information Transfer Specification (WITS) protocol, associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing a computer (402), wherein each computer (402) communicates over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In general, the disclosure presented describes collecting various drilling parameters from historical drilling signals into one real-time database and using the Fourier Transform to decompose functions based on ROP analysis of each drilling parameter and recompose those functions to automate the drilling activities for new wells. One or more embodiments does not need downhole sensing devices to measure the drilling parameters and instead uses devices, assemblies, systems, and methods to measure, analyze and filter the drilling parameters (signals) and generating one or more trends useful in the determination of the optimum drilling parameter to be applied for the particular field and depth of the well, as well as creating some KPI to follow-up on the performance of the drilling activities.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining, using a computer processor and from a plurality of surface sensors, a plurality of historical drilling signals for a plurality of previously drilled wells, wherein the plurality of historical drilling signals correspond to a Rate of Penetration (ROP) and a plurality of surface-measured drilling parameters is measured during drilling activities of the plurality of previously drilled wells;

applying, using the computer processor, Fourier Transform to decompose the plurality of historical drilling signals by at least converting the plurality of surface-measured drilling parameters as functions of time into the plurality of surface-measured drilling parameters as functions of frequency;

determining, using the computer processor, an optimum ROP based on one or more optimized surface-measured drilling parameters generated after measuring, analyzing, and filtering the plurality of surface-measured drilling parameters as functions of frequency;

generating trends of the one or more optimized surface-measured drilling parameters for each of the different formations of the plurality of previously drilled wells;

without deploying any downhole sensing devices to measure downhole drilling parameters of any new wells, using the trends of the one or more optimized surface-measured drilling parameters in making a decision related to the drilling activities of a new well based on prediction of a compressive strength of different formations of the plurality of previously drilled wells; and performing, in response to the decision, the drilling activities of the new well based on the prediction of the compressive strength of the different formations.

2. The method of claim 1, wherein the plurality of surface-measured drilling parameters comprise at least one or more of a Weight On Bit (WOB), a Rotation Per Minute (RPM), a Gallon Per Minutes (GPM), a hook-load, a torque, and a bit depth.

3. The method of claim 2, wherein the ROP is a function of at least one or more of the WOB, the RPM, the GPM, the hook-load, the torque, and the bit depth, wherein the plurality of historical drilling signals further correspond to well log data comprising rock characteristics of different formations of the plurality of previously drilled wells, and wherein the method further comprising:

without deploying any downhole sensing devices to measure downhole drilling parameters of the new well, using the trends of the one or more optimized surface-measured drilling parameters with respect to the rock characteristics of the different formations to identify a formation for locating a casing point of the new well; and installing, in response to locating the casing point, a new casing of the new well.

4. The method of claim 1, further comprising predicting and enhancing the ROP.

5. The method of claim 1, further comprising predicting problematic drilling zones of the well based on the optimum ROP drilling parameter.

6. The method of claim 1, further comprising predicting the ROP for each formation of the different formations using an optimum combination of each of the optimized surface-measured drilling parameters at a particular depth.

7. A system, comprising:

a drilling system;

a logging system comprising a plurality of drill bit logging tools, wherein the logging system is coupled to the drilling system;

a control system coupled to a plurality of surface sensors; and a reservoir simulator comprising a computer processor, wherein the reservoir simulator is coupled to the logging system and the drilling system, the reservoir simulator being configured to:

obtain, from the plurality of surface sensors, a plurality of historical drilling signals for a plurality of previously drilled wells, wherein the plurality of historical drilling signals correspond to a Rate of Penetration (ROP) and a plurality of surface-measured drilling parameters measured during drilling activities of the plurality of previously drilled wells;

apply Fourier Transform to decompose the plurality of historical drilling signals by at least converting the plurality of surface-measured drilling parameters as functions of time into the plurality of surface-measured drilling parameters as functions of frequency;

determine an optimum ROP based on one or more optimized surface-measured drilling parameters generated after measuring, analyzing, and filtering the plurality of surface-measured drilling parameters as functions of frequency;

generating trends of the one or more optimized surface-measured drilling parameters for each of the different formations of the plurality of previously drilled wells; and without deploying any downhole sensing devices to measure downhole drilling parameters of any new wells, use the trends of the one or more optimized surface-measured drilling parameters in making a decision related to the drilling activities of a new well based on prediction of a compressive strength of different formations of the plurality of previously drilled wells; and the drilling system performs, in response to the decision, the drilling activities of the new well based on the prediction of the compressive strength of the different formations.

8. The system of claim 7, wherein the plurality of surface-measured drilling parameters comprise at least one or more of a Weight On Bit (WOB), a Rotation Per Minute (RPM), a Gallon Per Minutes (GPM), a hook-load, a torque and a bit depth.

9. The system of claim 8, wherein the ROP is a function of at least one or more of the WOB, the RPM, the GPM, the hook-load, the torque, and the bit depth, wherein the plurality of historical drilling signals further correspond to well log data comprising rock characteristics of different formations of the plurality of previously drilled wells, and the reservoir simulator being further configured to:

without deploying any downhole sensing devices to measure downhole drilling parameters of the new well, use the trends of the one or more optimized surface-measured drilling parameters with respect to the rock characteristics of the different formations to identify a formation for locating a casing point of the new well; and the drilling system installs, in response to locating the casing point, a new casing of the new well.

10. The system of claim 7, wherein the reservoir simulator is further configured to predict and enhance the ROP.

11. The system of claim 7, wherein the reservoir simulator is further configured to predict problematic drilling zones of the well based on the optimum ROP.

12. A non-transitory computer readable medium storing instructions executable by a computer processor, the instructions comprising functionality for:

obtaining, from a plurality of surface sensors, a plurality of historical drilling signals for a plurality of wells, wherein the plurality of historical drilling signals correspond to a Rate of Penetration (ROP) and a plurality of surface-measured drilling parameters measured during drilling activities of the plurality of previously drilled wells;

applying Fourier Transform to decompose the plurality of historical drilling signals by at least converting the plurality of surface-measured drilling parameters as functions of time into the plurality of surface-measured drilling parameters as functions of frequency;

determining an optimum ROP based on one or more optimized surface-measured drilling parameters generated after measuring, analyzing, and filtering the plurality of surface-measured drilling parameters as functions of frequency;

generating trends of the one or more optimized surface-measured drilling parameters for each of the different formations of the plurality of previously drilled wells;

without deploying any downhole sensing devices to measure downhole drilling parameters of any new wells, using the trends of the one or more optimized surface-measured drilling parameters in making a decision related to the drilling activities of a new well based on prediction of a compressive strength of different formations of the plurality of previously drilled wells; and performing, in response to the decision, the drilling activities of the new well based on the prediction of the compressive strength of the different formations.

13. The non-transitory computer readable medium of claim 12, wherein the plurality of surface-measured drilling parameters comprise at least one or more of a Weight On Bit (WOB), a Rotation Per Minute (RPM), a Gallon Per Minutes (GPM), a hook-load, a torque, and a bit depth.

14. The non-transitory computer readable medium of claim 13, wherein the ROP is a function of at least one or more of the WOB, the RPM, the GPM, the hook-load, the torque, and the bit depth, wherein the plurality of historical drilling signals further correspond to well log data comprising rock characteristics of different formations of the plurality of previously drilled wells, and wherein the instructions further comprising functionality for:

without deploying any downhole sensing devices to measure downhole drilling parameters of the new well, using the trends of the one or more optimized surface-measured drilling parameters with respect to the rock characteristics of the different formations to identify a formation for locating a casing point of the new well; and installing, in response to locating the casing point, a new casing of the new well.

15. The non-transitory computer readable medium of claim 12, wherein the instructions further comprise functionality for predicting and enhancing the ROP.

16. The non-transitory computer readable medium of claim 12, wherein the instructions further comprise functionality for predicting problematic drilling zones of the well based on the optimum ROP.

17. The non-transitory computer readable medium of claim 12, wherein Fourier Transform predicts and optimizes the ROP and each drilling parameters of the plurality of drilling parameters.

18. The non-transitory computer readable medium of claim 12, wherein the instructions further comprise predicting the ROP for each formation of the different formations using an optimum combination of each of the optimized surface-measured drilling parameters at a particular depth.

* * * * *